US008424497B2

(12) United States Patent
Iwanicki

(10) Patent No.: US 8,424,497 B2
(45) Date of Patent: Apr. 23, 2013

(54) WATER PUMP ADAPTOR

(75) Inventor: David Iwanicki, Niantic, CT (US)

(73) Assignee: Moroso Performance Products, Inc., Guilford, CT (US)

( * ) Notice: Subject to any disclaimer, the term of this patent is extended or adjusted under 35 U.S.C. 154(b) by 265 days.

(21) Appl. No.: 12/896,512

(22) Filed: Oct. 1, 2010

(65) Prior Publication Data

US 2012/0079997 A1 Apr. 5, 2012

(51) Int. Cl.
*F01P 5/10* (2006.01)

(52) U.S. Cl.
USPC ..... 123/41.44; 123/41.01; 415/243.1

(58) Field of Classification Search ..... 123/41.44, 123/41.01; 415/213.1; 29/428; 285/328
See application file for complete search history.

(56) References Cited

U.S. PATENT DOCUMENTS

2007/0266806 A1* 11/2007 Jones ..... 74/11
2010/0162974 A1* 7/2010 Yamanishi et al. ..... 123/41.47

FOREIGN PATENT DOCUMENTS

JP 11062583 A * 3/1999

OTHER PUBLICATIONS

Ford Racing Parts123, 2005-2009 4.6L Water inlet/oil filter adaptor (http://fordracingparts123.com/index.php?main_page=product_info&cPath=36_74&products_id=1000 "FordRacingparts123_Water Adaptor.pdf". 2012.*
http://www.modularfords.com/f17/remote-oil-filter-setups-136611/index3.html "FordRacingparts123_Water Adaptor_Forum dating back to 2009.pdf"), 2009.*
Moroso Electric Water Pump adapter kit, No. 63566 or 63616 (http://www.moroso.com/catalog/categorydisplay.asp?catcode=29300 "GM LS engine water adapter.pdf"), 2011.*
Ford Racing Parts123, 2005-2009, 4.6L Water inlet/oil filter adaptor http://fordracingparts123.com/index.php?main_page=product_info&cPath=36_74&products_id=100.*

* cited by examiner

*Primary Examiner* — Noah Kamen
*Assistant Examiner* — Long T Tran
(74) *Attorney, Agent, or Firm* — St. Onge Steward Johnston & Reens LLC

(57) ABSTRACT

A water pump adaptor and water pump adaptor kit for adapting a conventional electrical and mechanical water pump to an engine block having at least one rectangular coolant entry port and at least one circular coolant exit port, such as a GM LS engine. A method for installing a water pump adaptor kit to adapt a water pump to an engine having at least one rectangular coolant entry port and at least one circular coolant exit port.

21 Claims, 11 Drawing Sheets

WATER PUMP ADAPTOR

FIELD OF THE INVENTION

The present invention relates to a water pump adaptor apparatus and kit for adapting a conventional electrical and mechanical water pump to an engine block having at least one rectangular coolant entry port and at least one circular coolant exit port.

BACKGROUND OF THE INVENTION

Water pump adaptors are used to connect a water pump to an engine block, the water pump allowing for coolant to be pumped through and to circulate through an engine block, thus cooling the engine block. The coolant acts as a heat sink, as the excess heat from the engine is transferred to the coolant upon circulation through the engine. The coolant prevents the engine from overheating, which is advantageous, as the excess heat from the engine is drawn away from the engine via the coolant.

Prior art designs, such as conventional Chevrolet® engine blocks, involve coolant entering the engine block through two round holes in the front of the block. From there, the coolant is circulated around the cylinder bores, up through the head gaskets into the cylinder heads and, out through the intake manifold. The coolant passes through a thermostat housing and is returned to the radiator in the vehicle.

Chevrolet® has recently introduced its LS engine, the LS engine block having one or more rectangular coolant entry ports and one or more circular coolant exit ports. Typically, the LS engine has two rectangular coolant entry ports and two circular coolant exit ports.

For the LS engine, coolant enters the engine from the pressure side of the water pump through the lower, rectangular shaped openings in the front of the block. Once pumped in, the coolant circulates around the cylinder bores, up through the head gaskets and into the cylinder heads. From the cylinder heads, the coolant than moves forward and down into the block once again and out through the round ports located above the rectangular ports. Then the coolant is returned to the vehicle's radiator.

Chevrolet® currently markets a LS engine specific water pump. This Chevrolet® water pump is expensive and bulky, and is designed to be specific to the LS engine block. The water pump supplied by Chevrolet is a large casting that incorporates the thermostat and housing on the inlet side of the pump. To date, aftermarket offerings have mimicked this design.

However, since the LS engine specific engine water pump is bulky and expensive, there is a need in the industry to adapt conventional electric and mechanical water pumps to the GM LS engine.

What is desired, therefore, is to provide a water pump adaptor that allows a standard conventional water pump to be adapted to an engine having at least one rectangular coolant entry port and at least one circular coolant exit port, such as the GM LS engine. Furthermore, it is desired for the water pump adaptor to be provided as part of a kit such that the kit can be provided, and sold, such that the kit can adapt a standard conventional water pump to an engine having at least one rectangular coolant entry port and at least one circular coolant exit port.

It is also desired to provide a method of installing the water pump adaptor kit to adapt a water pump to an engine having at least one rectangular coolant entry port and at least one circular coolant exit port.

SUMMARY OF THE INVENTION

Accordingly, it is an object of the present invention to provide a water pump adaptor that allows a standard conventional electric or mechanical water pump to be adapted to an engine having at least one rectangular coolant entry port and at least one circular coolant exit port, such as a GM LS series engine. Furthermore, it is an object of the present invention to provide a water pump adaptor to be provided as part of a kit such that the kit can be provided to adapt a standard conventional water pump to an engine having at least one rectangular coolant entry port and at least one circular coolant exit port.

It is another object of the invention to provide a method of installing a water pump adaptor kit to adapt a water pump to an engine having at least one rectangular coolant entry port and at least one circular coolant exit port.

These and other objectives are achieved by providing a water pump adaptor kit for an engine having at least one rectangular coolant entry port and at least one circular coolant exit port comprising: a water pump; at least one adaptor element, the at least one adaptor element able to conform to said engine, wherein said adaptor element comprises: a proximal side, a distal side, and a longitudinal surface attaching said proximal side and said distal side, a rectangular opening corresponding to said at least one rectangular coolant entry port of said engine, a first circular opening corresponding to said at least one rectangular coolant entry port of said engine, and a second circular opening corresponding to said water pump, wherein said second circular opening is on the opposite side of said rectangular opening and said first circular opening, and wherein said at least one adaptor element attaches said water pump to said engine.

The water pump in the kit may be either an electric water pump or a mechanical water pump.

The kit may further comprise at least one pump adaptor plate. The pump adaptor plate may correspond to the second circular opening of said adaptor element. The pump adaptor plate may additionally have a hole of reduced diameter, the hole having its radius face the inlet direction.

The kit may further comprise an additional opening on said longitudinal surface of said at least one adaptor element.

The additional opening on the longitudinal surface and the first circular opening may be connected via a first channel through the at least one adaptor element.

The rectangular opening and the second circular opening may be connected via a second channel through the at least one adaptor element.

The adaptor element may further comprise at least one fitting to attach said adaptor element to said engine at said additional opening on said longitudinal surface of said adaptor element. The at least one fitting allows coolant to enter and exit the adaptor element.

The kit may be provided such that there are two adaptor elements in the kit. The kit may be provided such that the engine block has two rectangular coolant entry ports and two circular coolant exit ports. The two adaptor elements in the kit correspond to the two rectangular coolant entry ports and two circular coolant exit ports of the engine block The kit may further comprise at least one hole in said adaptor element allowing for at least one screw to attach said adaptor element to said engine and to said water pump.

The kit may involve working with an engine, wherein the engine is a GM LS engine. The LS designation refers to the Gen III engine family of GM V-8's.

Other objectives of this invention are met by providing a water pump adaptor for an engine having at least one rectangular coolant entry port and at least one circular coolant exit port comprising: a proximal side, a distal side, and a longitudinal surface attaching said proximal side and said distal side, a rectangular opening corresponding to said at least one rectangular coolant entry port of said engine, a circular opening corresponding to said at least one rectangular coolant entry port of said engine, and a second circular opening corresponding to said water pump, a second circular opening corresponding to said water pump, wherein said second circular opening is on the opposite side of said rectangular opening and said first circular opening.

The adaptor may further comprise an additional opening on said longitudinal surface of said water pump adaptor. The adaptor may further comprise one fitting to attach said adaptor element to said engine at said additional opening on said longitudinal surface of said adaptor element. The at least one fitting may allow coolant to enter and exit the adaptor element.

The adaptor may further comprise a first channel through the water pump adaptor, the first channel connecting the additional opening on the longitudinal surface to the first circular opening.

The adaptor may further comprise a second channel through the water pump adaptor, the second channel connecting the rectangular opening to the second circular opening.

The adaptor may further comprise at least one hole in said adaptor element allowing for at least one screw to attach said adaptor element to said engine and to a water pump.

Other objectives of this invention are met by providing a method of installing a water pump adaptor kit to adapt a water pump to an engine having at least one rectangular coolant entry port and at least one circular coolant exit port comprising: providing a water pump; providing an engine, said engine having at least one rectangular coolant entry port and at least one circular coolant exit port; providing at least one adaptor element, said at least one adaptor element able to conform to said engine, wherein said adaptor element comprises: a proximal side, a distal side, and a longitudinal surface attaching said proximal side and said distal side, a rectangular opening corresponding to said at least one rectangular coolant entry port of said engine, a first circular opening corresponding to said at least one rectangular coolant entry port of said engine, and a second circular opening corresponding to said water pump, wherein said second circular opening is on the opposite side of said rectangular opening and said first circular opening; providing at least one pump adaptor plate; attaching said water pump to said at least one adaptor element and to said at least one pump adaptor plate via screws; and attaching said adaptor element said engine via screws, ensuring that said first circular opening of said at least one adaptor element corresponds to the at least one circular coolant exit port of said engine and said rectangular opening of said at least one adaptor element corresponds to the at least one rectangular coolant entry port of said engine.

The method may further involve the step of attaching two adaptor elements and two pump adaptor plates to said water pump and said engine.

The method may further involve the at least one pump adaptor plate has a hole of reduced diameter, the hole having its radius face the inlet direction.

The engine of the method may be a GM LS engine.

Other objects of the invention and its particular features and advantages will become more apparent from consideration of the following drawings and accompanying detailed description. It should be understood that the detailed description and specific examples, while indicating the preferred embodiment of the invention, are intended for purposes of illustration only and are not intended to limit the scope of the invention.

DETAILED DESCRIPTION OF THE INVENTION

The advantages of the water pump adaptor of the present invention allow for lower cost, smaller dimensions and the availability of a wide variety of water pumps to be adapted to an engine block having a at least one rectangular coolant entry port and at least one circular coolant exit port, such as a GM LS engine.

The LS designation refers to the GM Gen III engine family of GM V-8's. This family includes engines with the following RPO codes, LS1, LS2, LS3, LSX, LS6, LR4, LM4, LM7, L59, LQ4, LQ9, LS7 and aftermarket LS engine platforms. The kit consists of the following components: two machined aluminum water pump adaptor blocks (right and left), two pump adaptor plates with radius openings, fasteners, O-rings and high-flow 12AN fittings.

The kit works as water is drawn into the pump from the bottom radiator hose and directed to the adaptor blocks fastened to the front of the Gen III engine. Before entering the adaptor blocks, the water passes through a pair of plates with a hole of reduced diameter, made necessary to align with the water ports. These adaptor plates feature a radius facing the inlet direction to minimize flow losses. The plates are sealed to be blocks with an O-ring. Water or another coolant enters the engine block and circulates around the cylinder bores, up through the head gaskets, through the cylinder heads, back down into the front of the engine block and out through the exit ports located above the inlet ports. This is the same path coolant travels in the OEM configuration. Coolant than enters the adapter blocks and exits through a pair of high flow 12AN fittings. Coolant can be routed directly to the radiator or through a thermostat housing completing the cycle.

Figure 1:
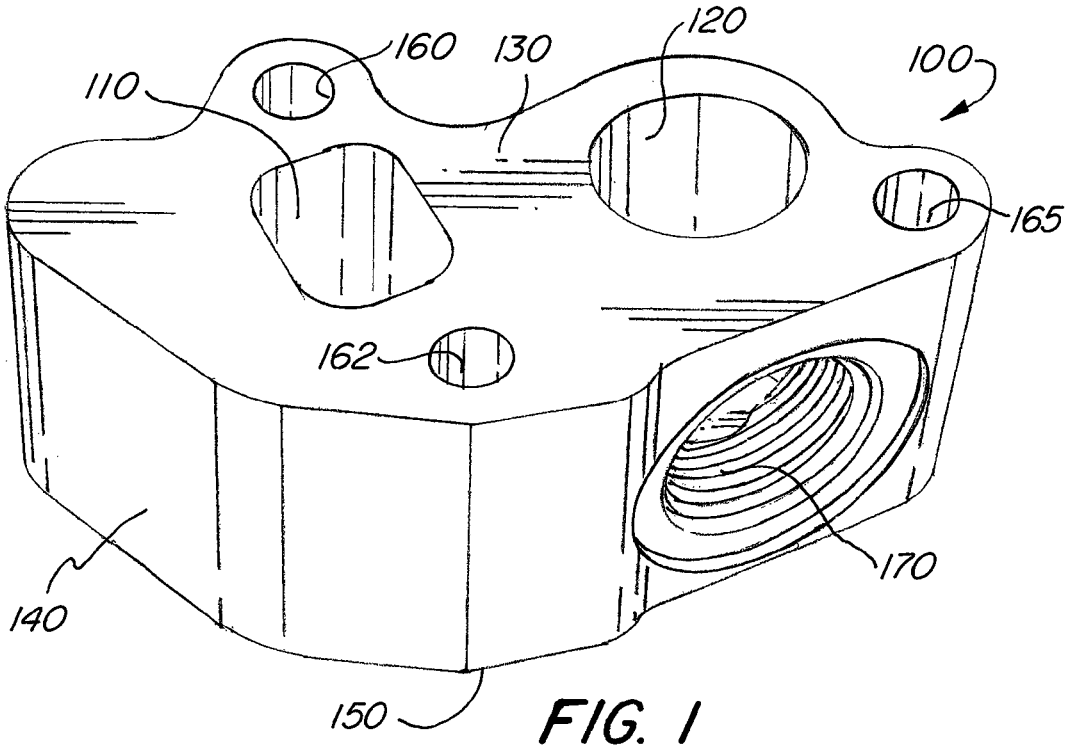
FIG. 1 is a perspective view of the proximal side of the water pump adaptor.

Referring to FIG. 1, the water pump adaptor 100 (also referred to as an adaptor element) is shown having a proximal side 130, longitudinal surface 140, and distal side 150. Longitudinal surface 140 connects proximal side 130 to distal side 150. Longitudinal surface 140 extends all around water pump adaptor 100.

Rectangular opening 110 and first circular opening 120 are shown as openings in proximal side 130. Additional opening 170 is shown as an opening in longitudinal surface 140. Additional opening 170 is shown as ribbed in FIG. 1, however, this is not necessarily required. The ribbed feature of additional opening 170 may be used to receive an attachment means such as a screw, or other such attachment means.

Also shown in FIG. 1 are through-holes 160, 162 and 165, which are shown as holes in proximal side 130. The through-holes allow for an attachment means such as a screw to pass through the holes. The attachment means (screws) may attach the water pump adaptor 100 to an engine 5000 and to water pump 5500 (both not shown in FIG. 1).

Figure 2:
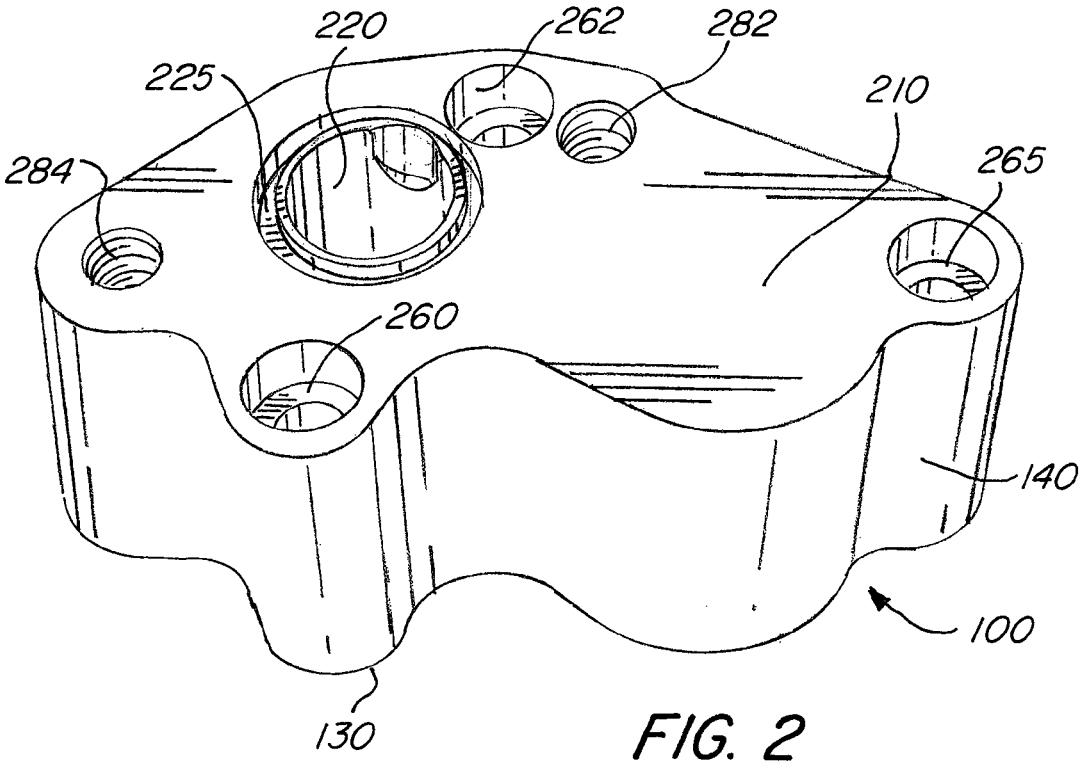
FIG. 2 is a perspective view of the distal side of the water pump adaptor.

FIG. 2 shows distal side 210 (corresponding to distal side 150 of FIG. 1), having second circular opening 220. Second circular opening 220 corresponds to rectangular opening 110, as the second opening extends though water pump adaptor 100 and eventually reaches rectangular opening 110. This forms a channel 1000 (not shown in FIG. 2) whereby fluid, such as coolant, can pass through both second circular opening 220 and rectangular opening 110

Also shown in FIG. 2 are through-holes 260, 262 and 265, which correspond to through-holes 160, 162 and 165, respectively, as shown in FIG. 1. Holes 260, 262 and 265 are shown having an expanded inner portion, so that a screw head may fit inside these holes. Alternatively, the expanded inner portions may be present on side of through-holes 160, 162 and 165.

FIG. 2 also has other holes 282 and 284. These holes have a ribbed interior allowing for a screw to be inserted into these holes. Holes 282 and 284 are not shown as through-holes. The invention may have more or less than three through-holes 260, 262 and 265 and the invention may have more or less than two holes 282 and 284.

Second circular opening 220 is also shown having an indented circumference 225 surrounding second circular opening 220 Indented circumference 225 may be filled with a ring that is preferably made out of a rubber or rubber-like material. The ring is used so that when the water pump adaptor is adapted to water pump 5500 or to engine 5000, then the ring interacts to soften the attachment, and so the rubber or rubber like material will interact with the surface, rather than having a metal on metal interaction. The indented circumference 225 is not required in all embodiments of the invention.

Figure 14:
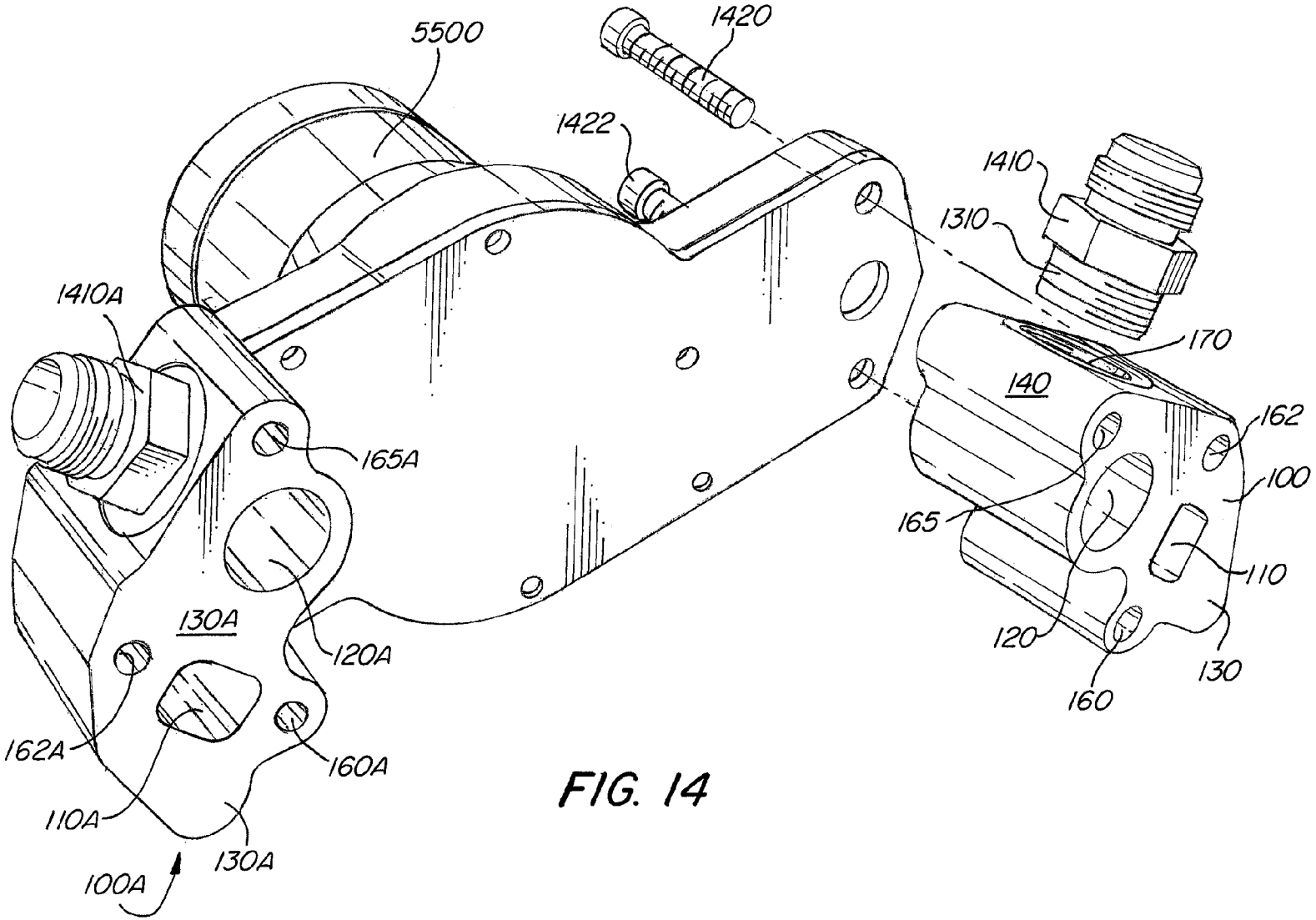
FIG. 14 is an exploded view of two water pump adaptors and an electric water pump.

The water pump adaptor 100 can also be in mirror image form (as in FIG. 14).

Figure 3:
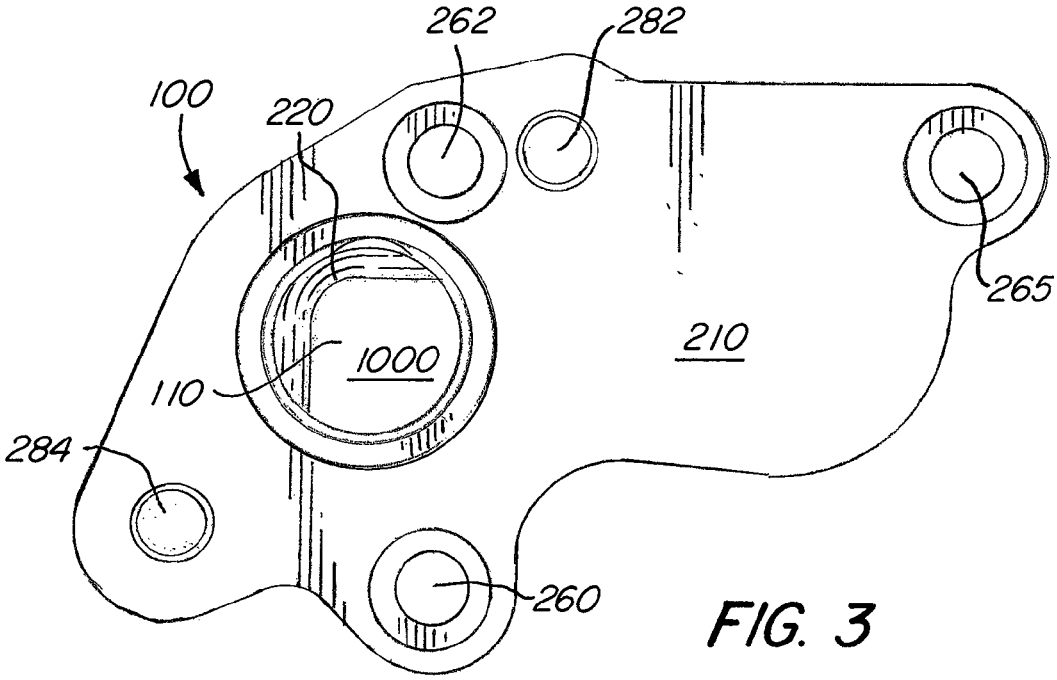
FIG. 3 is a top view of the distal side of the water pump adaptor.

FIG. 3 shows a top view of distal side 210 of water pump adaptor 100. Here one can see second circular opening 220 corresponding to rectangular opening 110, forming channel 1000. Furthermore, through-holes 260, 262 and 265 are shown being through-holes, while holes 282 and 284 are shown as not being through-holes.

Figure 4:
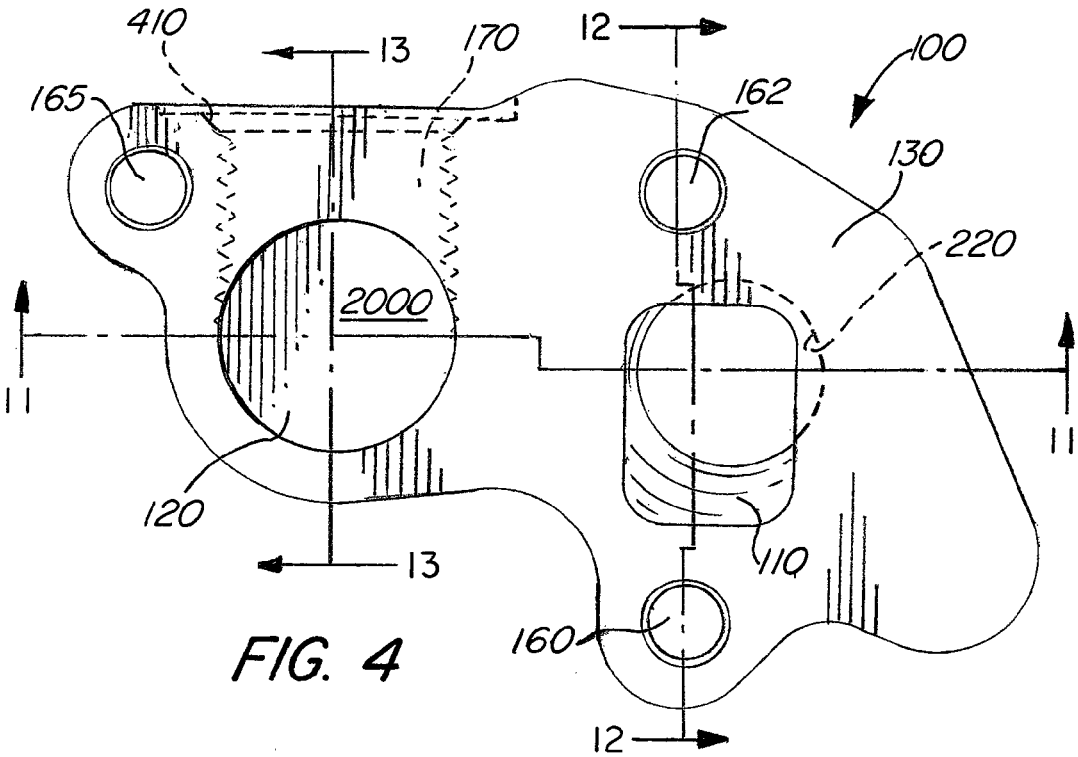
FIG. 4 is top view of the proximal side of the water pump adaptor.

FIG. 4 is a top view of proximal side 130 having thru-holes 160, 162 and 165. Additional opening 170 is also shown in phantom form (having broken lines). Furthermore, FIG. 4 shows second circular opening 220 corresponding to rectangular opening 110, forming channel 1000. Also shown is additional opening tip 410, which may be indented and also may be wider than additional opening 170, so that an attachment means may correspond to the indentation of additional opening tip 410 (Shown as attachment means 1410 in FIG. 14).

FIG. 4 also shows first circular opening 120 corresponding to additional opening 170 forming channel 2000.

Figure 5:
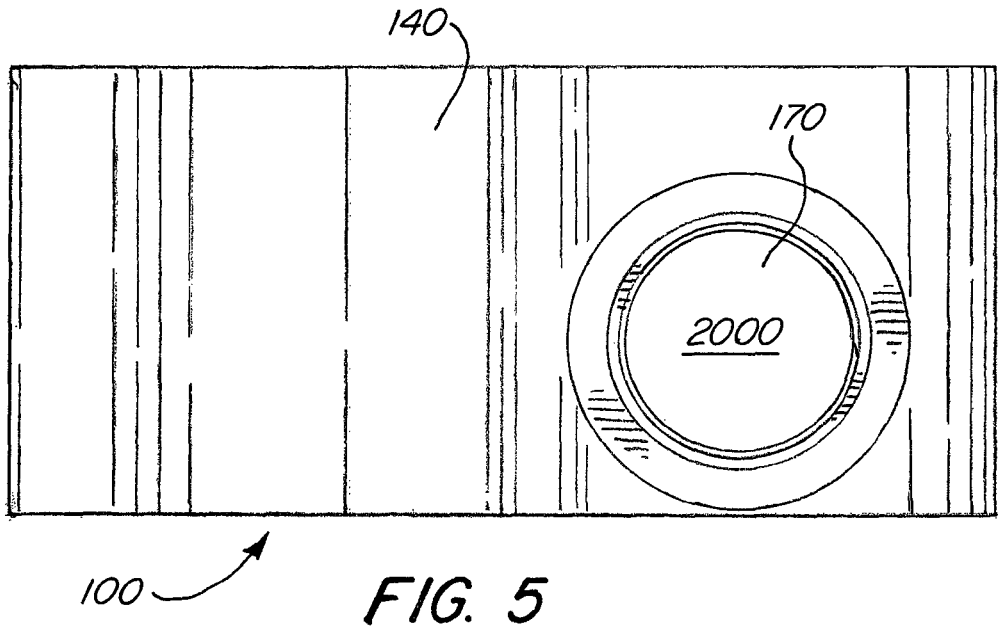
FIG. 5 is side view of the longitudinal surface of the water pump adaptor showing an additional opening.
Figure 6:
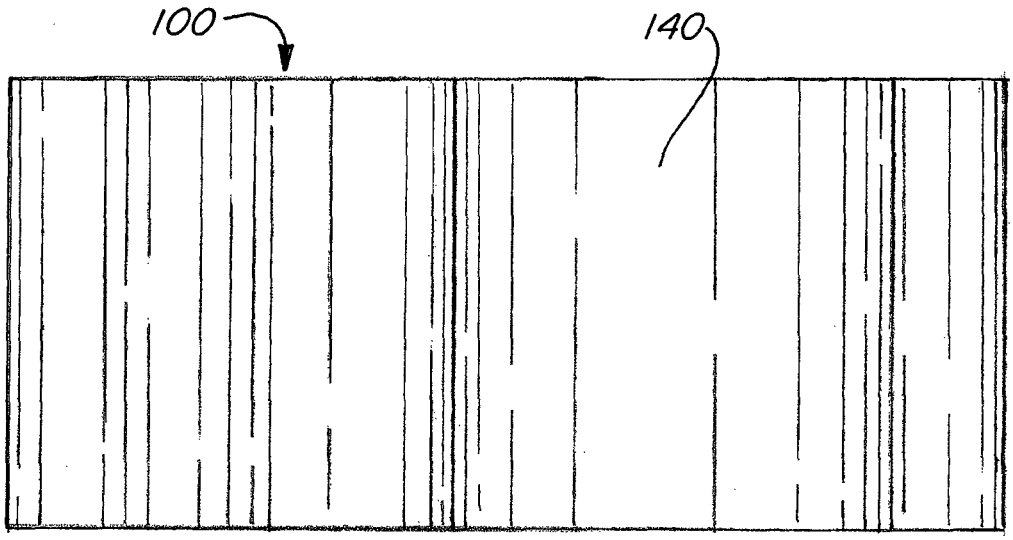
FIG. 6 is side view of the longitudinal surface of the water pump adaptor.
Figure 7:
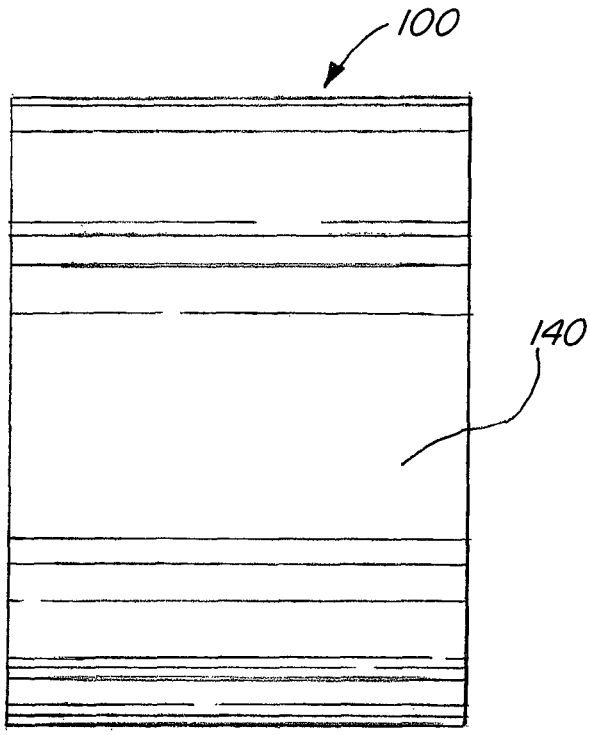
FIG. 7 is side view of the longitudinal surface of the water pump adaptor.
Figure 8:
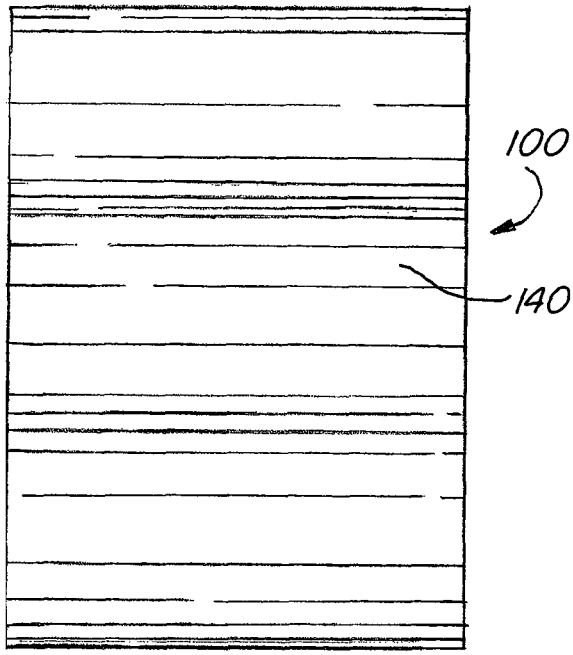
FIG. 8 is side view of the longitudinal surface of the water pump adaptor.

FIGS. 5-8 are side views of longitudinal surface 140 whereby additional hole 170 is shown in FIG. 5. These views are used to show that longitudinal surface 140 extends around water pump adaptor 100. Further, FIG. 5 shows that channel 2000 extends through additional opening 170.

Figure 9:
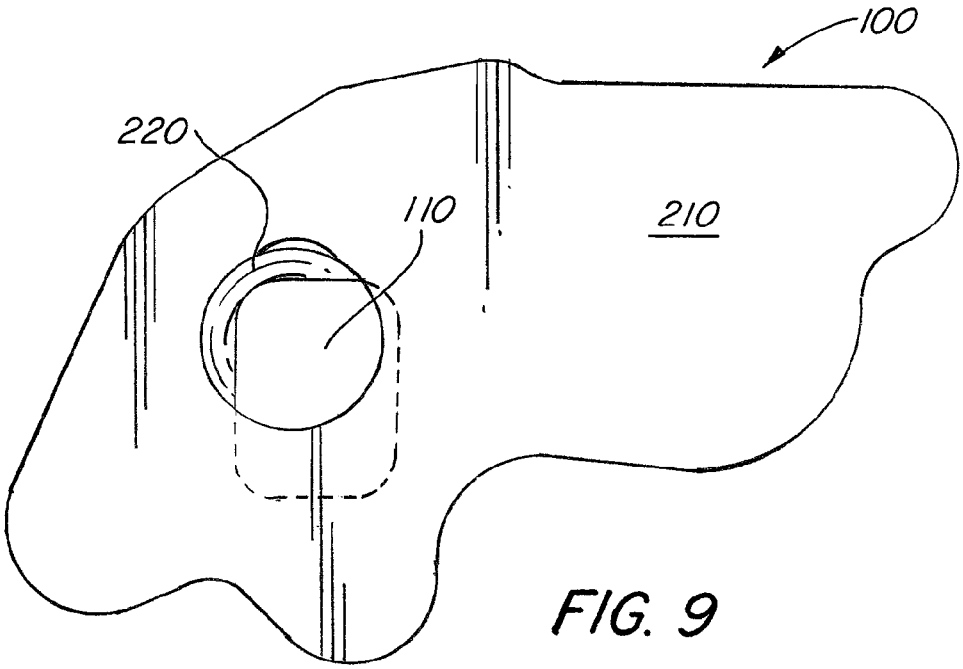
FIG. 9 is flat view of the distal side of the water pump adaptor showing the channel formed by the rectangular opening and the second circular opening.
Figure 10:
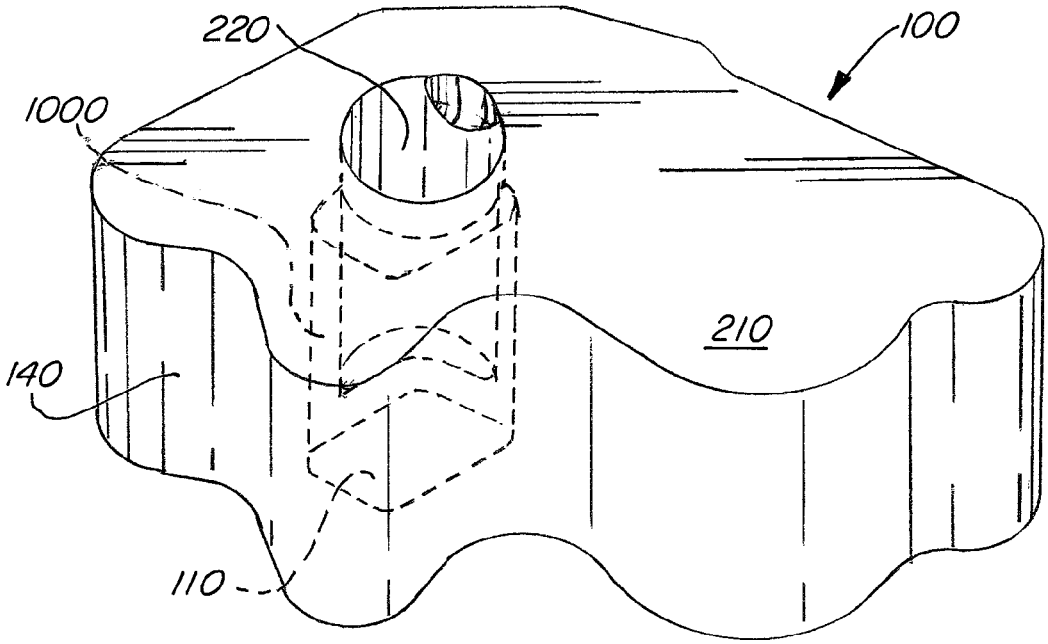
FIG. 10 is a perspective view of the distal side of the water pump adaptor only displaying the channel formed by the rectangular opening and the second circular opening.

FIGS. 9-10 are additional views which show the depth of channel 1000. Distal side 210 is shown with second opening 220 and rectangular opening 110 is shown in broken line form. The depth of channel 1000 is shown in FIG. 10.

Figure 11:
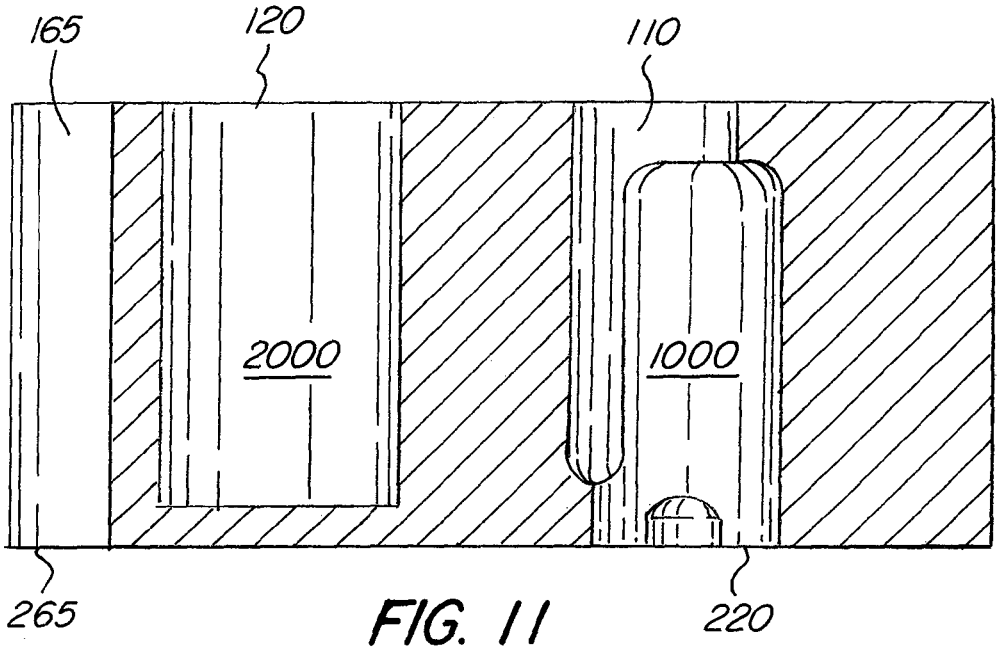
FIG. 11 is a cross-section view across I1 of FIG. 4.
Figure 12:
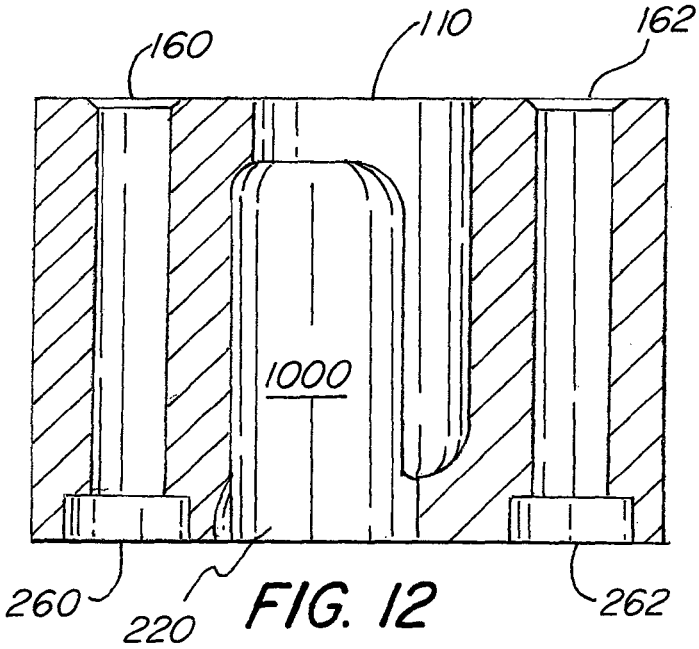
FIG. 12 is a cross-section view across I2 of FIG. 4.

FIGS. 11-12 are cross-section views across I1 and I2 of FIG. 4, respectively. In FIG. 11 channels 1000 and 2000 are shown as well as the through-hole between openings 165 and 265. FIG. 12 shows channel 1000 as well as the through-holes between 160 and 260 as well as 162 and 262.

Figure 13:
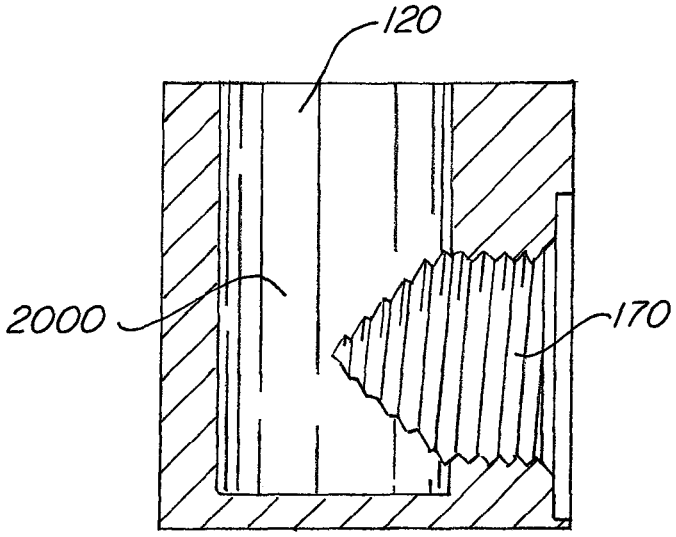
FIG. 13 is a cross-section view across I3 of FIG. 4.

FIG. 13 is a cross-section view that shows additional opening 170 and first circular opening 120 forming channel 2000. Fluid is able to pass through channel 2000.

FIG. 14 is exploded view of water pump 5500 attached to water pump adaptor 100 and to water pump adaptor 100A, which is a mirror image of pump adaptor 100. Water pump 5500 is attached to water pump adaptor 100 and water pump adaptor 100A via an attachment means, typically screws. In FIG. 14 water pump adaptors 100 and 110A are shown having first circular openings 120 and 120A, rectangular openings 110 and 110A, as well as through-holes 160, 162, 165, 160A, 162A and 165A. Screws 1420 and 1422 are shown able to pass through these through-holes to attach the water pump adaptor 100 and 100A to water pump 5500.

FIG. 14 also shows using electric water pump 5500. In other embodiments, a conventional mechanical pump can be used rather than an electric water pump.

FIG. 14 also shows screws 1410 and 1410A that are able to attach to additional opening 170 and 170A. The end 1310 of attachment means 1410 is shown to attach the element 1410 to the adaptor element 100.

Figure 15:
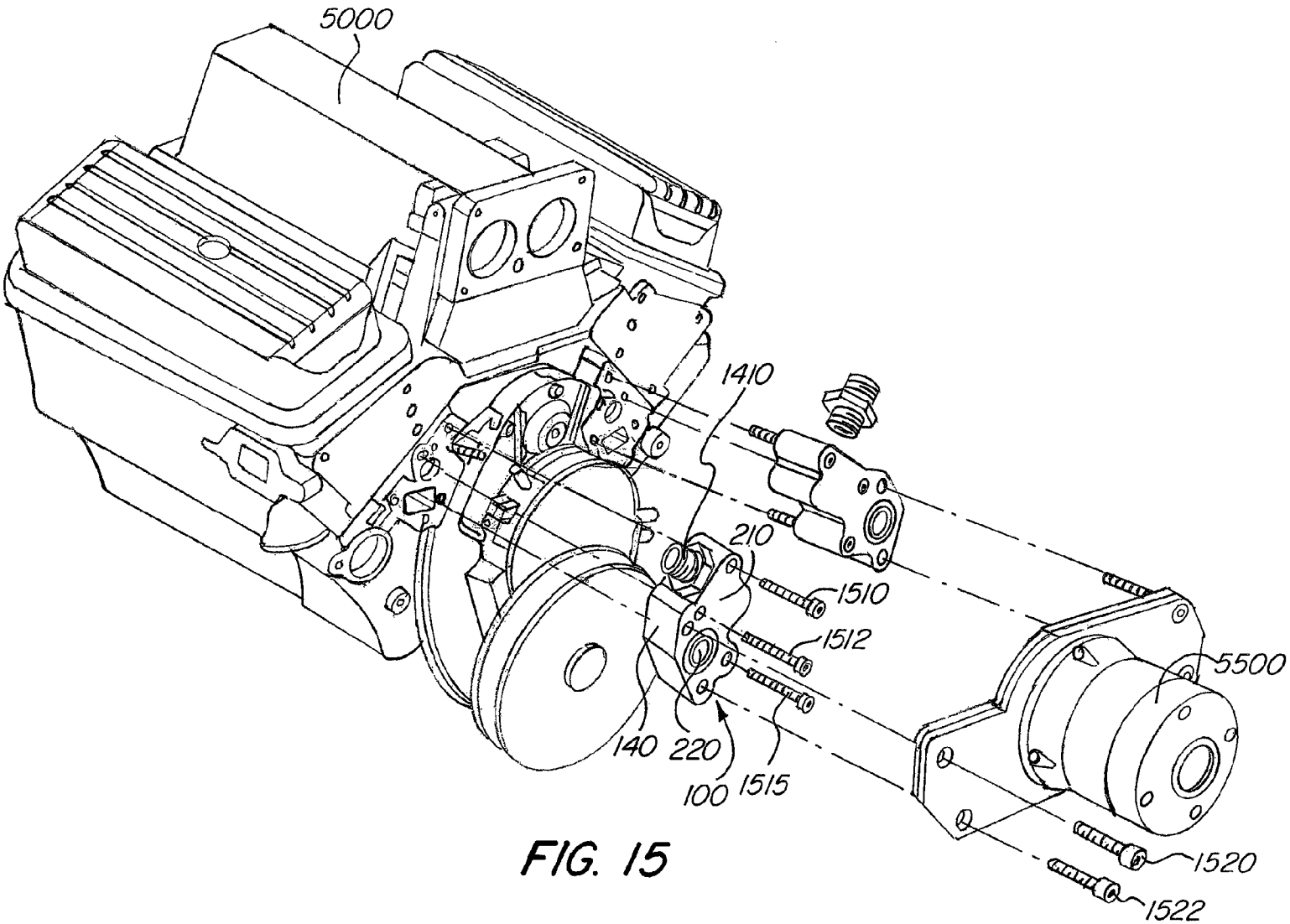
FIG. 15 is an exploded view of an embodiment of the invention involving a water pump, water pump adaptors and an engine.

FIG. 15 is an exploded view of an engine (such as a GM LS engine) 5000, water pump adaptor 100 (also 100A is shown) and water pump 5500. Here, the size of water pump adaptor 100 (and 100A) is shown relative to the engine 5000 and water pump 5500. Further, screws 1520 and 1522 are shown which attach water pump 5500 to water pump adaptor 100, and also screws 1510 and 1512 which are used to attach water pump adaptor 100 to engine 5000.

The screws that travel through the through-holes in water pump adaptor 100 are used to attach water pump 5000 to water pump adaptor 100 and the other holes are used to attach water pump adaptor 100 to engine 5000.

Figure 16:
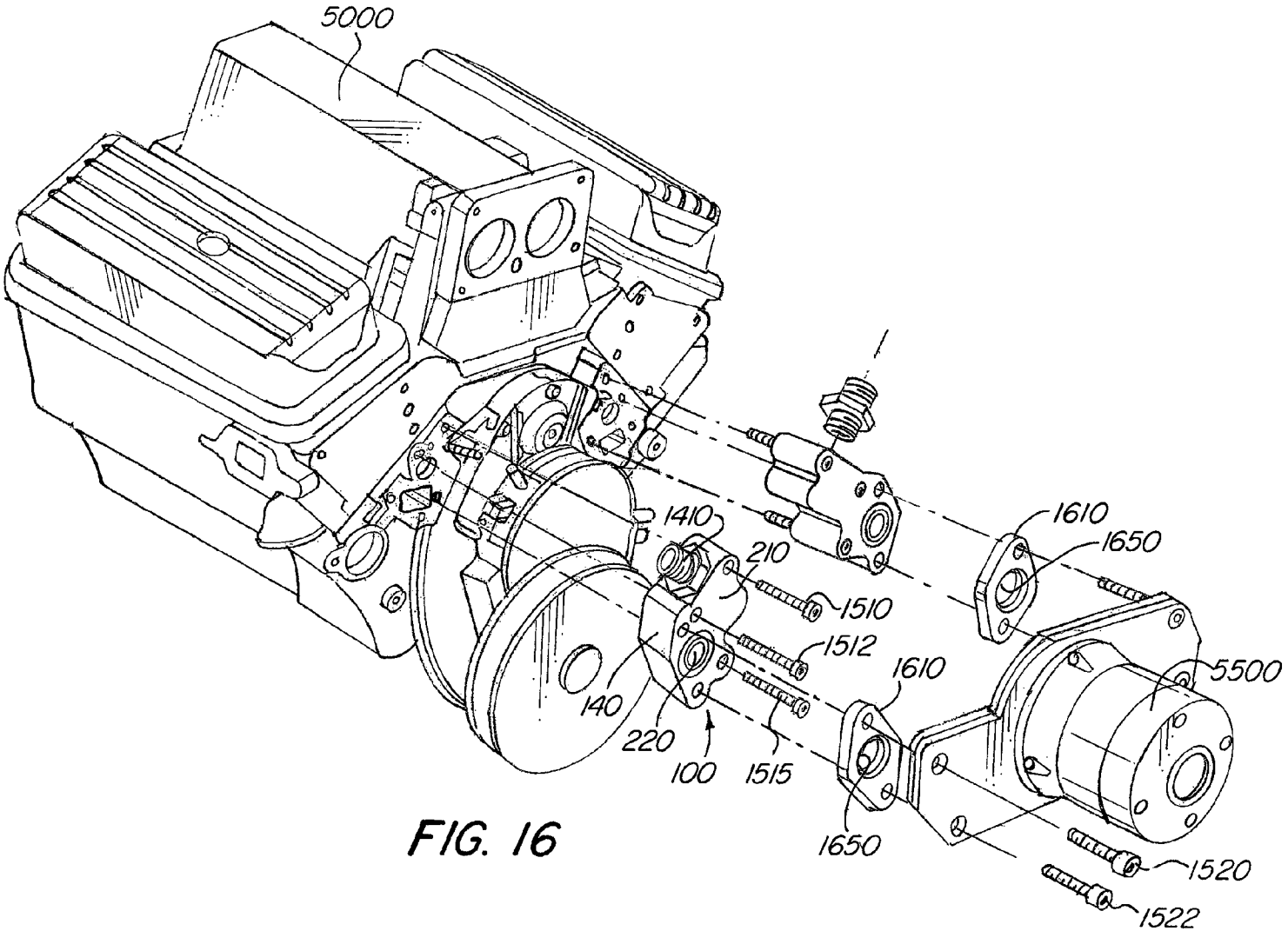
FIG. 16 is an exploded view of a an embodiment of the invention involving a water pump, water pump adaptors, water pump adaptor plates and an engine.

FIG. 16 shows another embodiment of the invention having adaptor plates 1610. Adaptor plates 1610 have a hole of reduced diameter 1650.

Figure 17A:
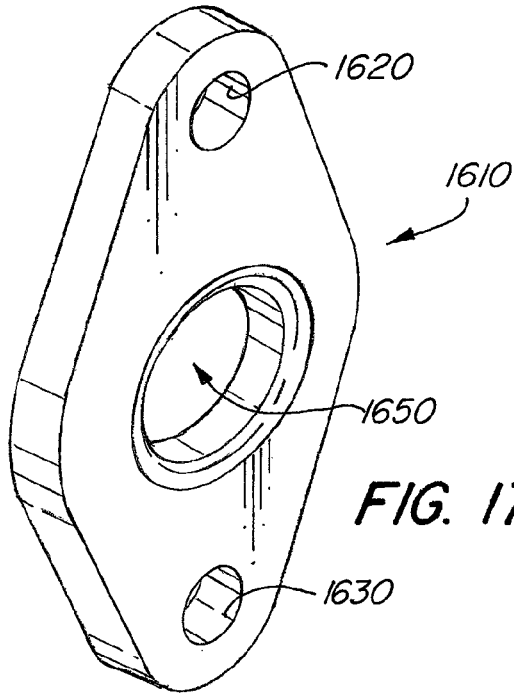
FIG. 17A is an isometric view of the water pump adaptor plate.
Figure 17B:
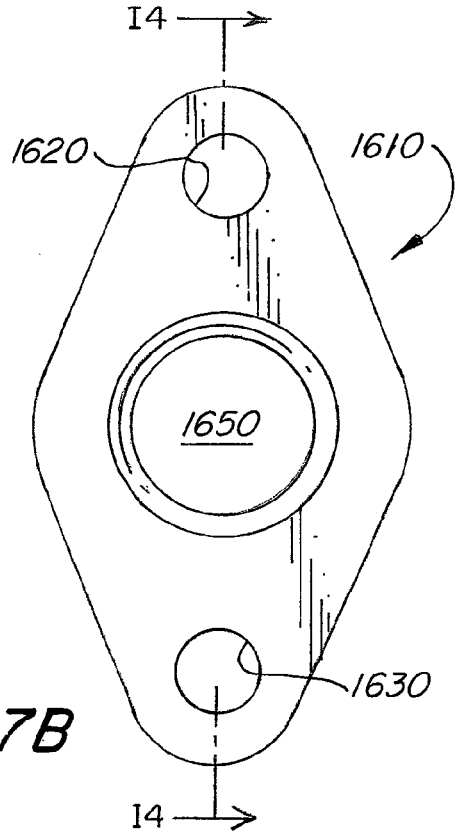
FIG. 17B is a top view of the water pump adaptor plate of FIG. 17A.
Figure 17C:
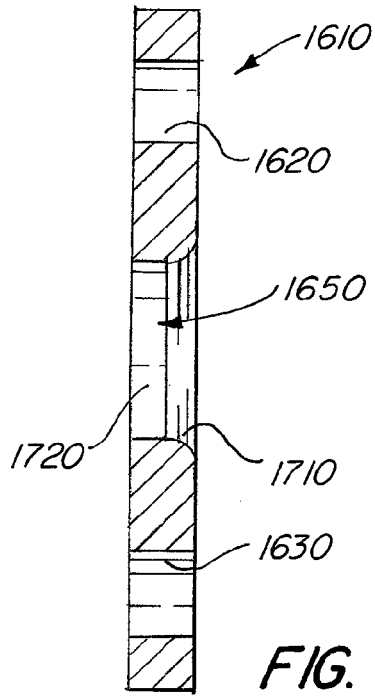
FIG. 17C is a cross section view of the water pump adaptor plate across I4 of FIG. 17B.

FIGS. 17A-17C show different views of adaptor plate 1610. Here, adaptor plate 1610 is shown having a hole of reduced diameter as well as through-holes 1620 and 1630.

FIG. 17, which is a cross-section view along I4 of FIG. 17B shows through-holes 1620 and 1630, as well as, hole of reduced diameter 1650 having portion 1710, whereby the circumference of the hole is reduced along the length of the hole. Portion 1720 may have a fixed circumference or may additionally have its diameter be reduced (not shown).

The adaptor plates discussed here are used to connect a merely conventional water pump to an "LS" style engine.

While the invention has been specifically described in connection with certain specific embodiments thereof, it is to be understood that this is by way of illustration and not of limitation and that various changes and modifications in form and details can be made thereto, and the scope of the appended claims should be construed as broadly as the prior art will permit.

The description of the invention is merely exemplary in nature, and thus, variations that do not depart from the gist of the invention are intended to be within the scope of the invention. Such variations are not to be regarded as a departure from the spirit and scope of the invention.

What is claimed is:

1. A water pump adaptor kit for an engine having at least one rectangular coolant entry port and at least one circular coolant exit port comprising:

a water pump; and at least one adaptor element, said at least one adaptor element able to conform to an engine and attach said water pump to said engine, wherein said adaptor element comprises:

a proximal side, a distal side, and a longitudinal surface attaching said proximal side and said distal side, a rectangular opening, said rectangular opening located on said proximal side of the adaptor element, said rectangular opening corresponding to said at least one rectangular coolant entry port of said engine, a first circular opening, said first circular opening located on said proximal side of the adaptor element, said first circular opening corresponding to said at least one rectangular coolant entry port of said engine, and a second circular opening,said second circular opening located on said distal side of said adaptor element, said second circular opening corresponding to said water pump, and an additional opening, said additional opening located on said longitudinal surface of said at least one adaptor element, said additional opening being connected to said first circular opening forming a first channel within said at least one adaptor element.

2. The kit of claim 1, wherein said water pump is an electric water pump or mechanical water pump.

3. The kit of claim 1, further comprising at least one pump adaptor plate.

4. The kit of claim 3, wherein said at least one pump adaptor plate corresponds to the second circular opening of said adaptor element.

5. The kit of claim 4, wherein said at least one pump adaptor plate has a hole of reduced diameter, the hole having its radius face the inlet direction.

6. The kit of claim 1, further comprising at least one fitting to attach said adaptor element to said engine at said additional opening on said longitudinal surface of said adaptor element.

7. The kit of claim 6, wherein said at least one fitting that allows coolant to enter and exit the adaptor element.

8. The kit of claim 1, further comprising a second channel, said second channel connecting said rectangular opening to said second circular opening.

9. The kit of claim 1, wherein said engine has two rectangular coolant entry ports and two circular coolant exit ports.

10. The kit of claim 1, wherein there are two adaptor elements in the kit.

11. The kit of claim 1, further comprising at least one hole in said adaptor element allowing for at least one screw to attach said adaptor element to said engine and to said water pump.

12. The kit of claim 1, wherein said engine is a GM LS engine.

13. A water pump adaptor for an engine having at least one rectangular coolant entry port and at least one circular coolant exit port comprising:

a proximal side, a distal side, and a longitudinal surface attaching said proximal side and said distal side, a rectangular opening, said rectangular opening located on said proximal side of the water pump adaptor, said rectangular opening corresponding to said at least one rectangular coolant entry port of said engine, a circular opening, said circular opening located on said proximal side of the water pump adaptor, said circular opening corresponding to said at least one rectangular coolant entry port of said engine, and a second circular opening, said second circular opening located on said distal side of the water pump adaptor, said second circular opening corresponding to said water pump, a second circular opening corresponding to said water pump, and an additional opening, said additional opening located on said longitudinal surface of said water pump adaptor, said additional opening being connected to said first circular opening forming a first channel within said water pump adaptor.

14. The adaptor of claim 13 therein said adaptor element, further comprises one fitting to attach said adaptor element to said engine at said additional opening on said longitudinal surface of said adaptor element.

15. The adaptor of claim 14, wherein said at least one fitting that allows coolant to enter and exit the adaptor element.

16. The adaptor claim 13, further comprising a second channel through said water pump adaptor, said second channel connecting said rectangular opening to said second circular opening.

17. The adaptor of claim 13 further comprising at least one hole in said adaptor element allowing for at least one screw to attach said adaptor element to said engine and to a water pump.

18. A method of installing a water pump adaptor kit to adapt a water pump to an engine having at least one rectangular coolant entry port and at least one circular coolant exit port comprising:

providing a water pump;

providing an engine, said engine having at least one rectangular coolant entry port and at least one circular coolant exit port;

providing at least one adaptor element, said at least one adaptor element able to conform to said engine, wherein said adaptor element comprises:

a proximal side, a distal side, and a longitudinal surface attaching said proximal side and said distal side, a rectangular opening, said rectangular opening located on said proximal side of the water pump adaptor, said rectangular opening corresponding to said at least one rectangular coolant entry port of said engine, a first circular opening, said first circular opening located on said proximal side of the water pump adaptor, said first circular opening corresponding to said at least one rectangular coolant entry port of said engine, and a second circular opening, said second circular opening located on said distal side of the water pump adaptor, said second circular opening corresponding to said water pump, and an additional opening, said additional opening located on said longitudinal surface of said water pump asaptor, said additional opening being connected to said first circular opening forming a first channel;

providing at least one pump adaptor plate;

attaching said water pump to said at least one adaptor element and to said at least one pump adaptor plate via screws; and attaching said adaptor element said engine via screws, ensuring that said first circular opening of said at least one adaptor element corresponds to the at least one circular coolant exit port of said engine and said rectangular opening of said at least one adaptor element corresponds to the at least one rectangular coolant entry port of said engine.

19. The method of claim 18, wherein the steps involve attaching two adaptor elements and two pump adaptor plates to said water pump and said engine.

20. The method of claim 18, wherein said at least one pump adaptor plate has a hole of reduced diameter, the hole having its radius face the inlet direction.

21. The method of claim 18, wherein said engine is a GM LS engine.

* * * * *